United States Patent [19]

Burkhard

[11] 4,335,780

[45] Jun. 22, 1982

[54] CONTINUOUS CASTING PLANT

[76] Inventor: Max Burkhard, Obere Zelglistrasse 7, CH 8600 Dübendorf, Switzerland

[21] Appl. No.: 134,469

[22] Filed: Mar. 27, 1980

[51] Int. Cl.[3] ..... B22D 11/124; B22D 11/00

[52] U.S. Cl. ..... 164/441; 164/444; 164/447; 198/621; 198/773

[58] Field of Search ..... 164/441, 447, 444; 198/621, 773; 226/112, 108

[56] References Cited

U.S. PATENT DOCUMENTS

| | | | |
|---|---|---|---|
| 1,272,918 | 7/1918 | Cram | 198/773 X |
| 1,992,331 | 2/1935 | Smith | 198/773 X |
| 2,107,607 | 2/1938 | Göbel | 198/621 X |
| 2,818,616 | 1/1958 | Rossi | 164/441 X |
| 2,895,190 | 7/1959 | Bungeroth et al. | 164/441 |
| 3,480,074 | 11/1969 | Bykov et al. | 164/447 |
| 3,556,198 | 1/1971 | Niskovskikh et al. | 164/441 |

FOREIGN PATENT DOCUMENTS

| | | | |
|---|---|---|---|
| 320886 | 3/1975 | Austria . | |
| 544029 | 2/1932 | Fed. Rep. of Germany . | |
| 275065 | 10/1969 | Fed. Rep. of Germany | 164/447 |
| 2017976 | 10/1971 | Fed. Rep. of Germany . | |
| 2052901 | 1/1972 | Fed. Rep. of Germany | 164/447 |
| 2046645 | 5/1972 | Fed. Rep. of Germany . | |
| 1608352 | 10/1972 | Fed. Rep. of Germany . | |
| 569367 | 11/1957 | Italy | 164/447 |
| 52-71340 | 6/1977 | Japan | 164/441 |
| 327056 | 8/1970 | Sweden | 164/447 |
| 1188816 | 4/1970 | United Kingdom | 164/447 |
| 1194783 | 6/1970 | United Kingdom | 164/447 |

*Primary Examiner*—Gus T. Hampilos

*Attorney, Agent, or Firm*—Stevens, Davis, Miller & Mosher

[57] ABSTRACT

The guiding section of a continuous casting plant comprises walking beams extending transversely to the longitudinal center plane of the path for the continuous casting. The beams are arranged in pairs of registering beams disposed on opposite sides of the path. A plurality of props are mounted in a guiding frame of said guiding section. Each of said beams is connected to at least one of said props at one end of the latter and is supported by said at least one prop in said guiding frame. Drive means are operatively connected to said beams by said props and operable to cyclically move each of said beams into and out of engagement with said casting and in the direction of movement of said casting when said beam engages said casting and opposite to the direction of movement of the casting when said beam is disengaged from said casting.

35 Claims, 11 Drawing Figures

CONTINUOUS CASTING PLANT

Figure 1A:
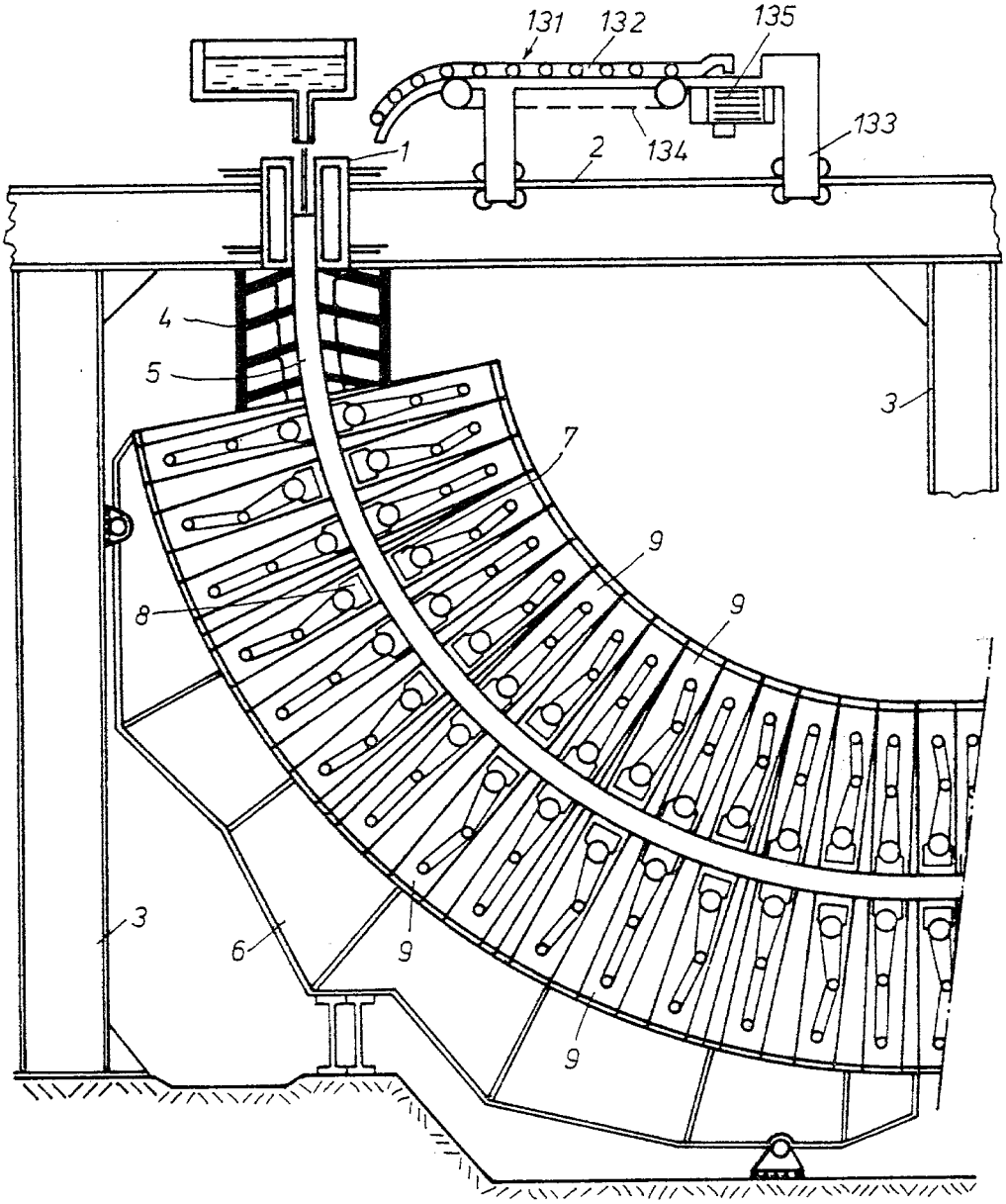

This invention relates to a continuous casting plant which serves particularly for producing slab stock, comprising a coolable open-ended mold, a guiding section for constraining the continuous casting to move along a predetermined, straight or arcuate path and for cooling said casting on said path, said guiding section comprising a guiding frame, walking beams arranged in two banks mounted in said frame and disposed on opposite sides of said path, and drive means associated with said walking beams and operable to move each of said beams into engagement with the continuous casting, to move said beam away from said mold for a predetermined distance while the beam engages the casting, to disengage the beam from the casting and to return the beam to an initial position, wherein the cyclic motion of one group of walking beams of each bank is displaced in phase by about one-half period from the cyclic operation of another group of walking beams of the same bank, and, where the guiding section defines an arcuate path for the casting, the walking beams are succeeded by straightening tools which are operable by drive means to straighten the casting.

An essential and highly expensive component of any continuous casting plant for advancing the casting along an arcuate path is the guiding section, which serves to deflect and cool the continuous casting after it has emerged substantially vertically from the mold. Known guiding sections for guiding the casting along a straight or arcuate path comprise two banks of rollers disposed on opposite sides of the path for the continuous casting. Each bank consists of a substantial number of rollers, which are subjected to very high unfavorable mechanical and thermal stresses and for this reason have a much shorter life than might be expected. Because each roller supports the skin of the continuous casting only on a very small strip-shaped area, adjacent rollers of each bank must be spaced apart as closely as possible so that only a closely restricted space is available for the means for spraying cooling water and said space has no favorable configuration. As a result, only a central portion of the skin of the casting between adjacent rollers can be effectively cooled whereas the rollers themselves do not contribute to the cooling. In the areas which are cooled, the skin of the casting is not supported so that it may bulge and is often deflected outwardly and inwardly as it moves between the banks of rollers. The structure obtained in the solidified casting is adversely affected by these deflections of the skin of the casting.

Ingots having different cross-sectional dimensions within a very wide range are required by the processing industry. When such ingots are made in that a continuous casting having the desired cross-section is cut to length, an existing plant for continuous casting must be altered for a change in cross-section. In order to eliminate the need for such expensive work and the standstill times involved therein, it is conventional to cut the ingots from slabs, which should be as wide as possible, for economical reasons but should have broadsides which are planar and parallel. For instance, ingots made by slitting a slab which has a width of 2700 mm cannot be satisfactorily rolled if they are about 1.5 mm thicker at one end than at the other. Slabs cannot be cast in the width which would be permitted by the existing casting technology because the convexity of a continuous slab casting which has been guided by rollers will depend on the deflection of the rollers. In fact, the permissible slab width depends on the deflection of the rollers. It is a rule of thumb that the roller diameters must be altered in proportion to the slab widths. For this reason, a limitation is presently imposed regarding the slab width because the rollers required to guide a slab having a width beyond such limit are too heavy and support the skin of the continuous casting at points which are spaced excessively large distances apart. Whereas it has been suggested to support the rollers not only at their ends but also at intermediate points of their length or to use composite rollers divided in length, these measures have not proved satisfactory.

It has also been proposed to provide continuous casting plants in which the continuous casting is guided along an arcuate path and is supported by walking beams disposed on opposite sides of said path, and such plants have al-ready been built. Such walking beams are curved and extend along and conform to the arcuate continuous casting. Two groups of such beams face each broadside of the continuous casting and a beam of each group is disposed between two adjacent beams of the other group. The beams of each group can be moved into engagement with the casting and can be moved in the longitudinal direction of the casting in engagement therewith and can subsequently be disengaged from the casting and returned to an initial position while they are disengaged from the casting. The cyclic motions of the two groups of longitudinal beams are displaced in phase by about one-half period. Such plants provide for an improved supporting and cooling of the continuous casting because the longitudinal beams can be cooled and are in surface contact with the skin of the continuous casting. On the other hand, the weight of the means for supporting the continuous casting and particularly the masses to be moved are large where wide slabs are to be handled.

This will also be the case if each longitudinal beam does not extend throughout the length of the arcuate portion of the continuous casting but the beams are divided in length. With continuous castings large in cross-section, the arcuate portion thereof may have a length of, e.g., 15 meters or more. In such arrangements, the entire guiding section is composed of a plurality of adjoining subsections. Whereas this arrangement results in a decrease of the total mass to be moved and in a division of said mass, this will not decrease the difficulties which relate to the driving means. These difficulties are due to the fact that the elements for driving each beam must be arranged over or under the continuous casting so that they are exposed to the heat radiated from the casting. As a result, the entire driving arrangement can be supervised only with difficulty and is inaccessible and subjected to high temperatures during operation. For this reason, even minor defects can be eliminated only when the plant has been shut down and permitted to cool. Besides, it is difficult and time-consuming to remove and replace those walking beams, which are disposed between the two outermost beams and are subjected to higher wear and there is an upper limit to the practically permissible frequencies of the beam motion even though the mass to be moved has been subdivided.

Continuous casting plants comprising guiding means of one type or the other are presently in use. So far, walking beams have not yet been decisively successful and guiding sections comprising rollers are still being constructed. Slabs having sufficiently parallel broadsides can presently be made up to a width of 180 to 220 cm but this involves a structural expenditure which is due to mechanical rather than metallurgical requirements. From the aspect of casting technology alone it would be possible to cast slabs in a width of 300 to 400 cm or even of 500 cm and this could be accomplished at relatively low cost. But limitations are imposed by the means for guiding the continuous casting. Particularly where rollers are used for this purpose, these means involve inherent difficulties which oppose the manufacture of slabs having parallel broadsides and such larger widths.

It is an object of the invention to provide a continuous casting plant in which the continuous casting is guided by means which permit a casting of slabs in a width that is much larger than presently usual, such means should be much lighter in total weight than the known guiding means and their total mass to be moved should be subdivided into a larger number of relatively small masses.

In a continuous casting plant of the kind defined first hereinbefore this object is accomplished according to the invention in that all walking beams extend transversely to the longitudinal center plane of the continuous casting and are arranged in pairs of walking beams disposed on opposite sides of the path for the casting, each walking beam is connected to one end of at least one prop and is supported by the prop or props against the guiding frame, the props are adapted to be driven so as to engage the walking beams with and to disengage them from the continuous casting and to move the walking beams away from and toward the mold along the path for the casting, and any straightening tools consist preferably also of transverse beams which are supported by props against the guiding frame or an additional frame and by means of the associated props can be engaged with and disengaged from the continuous casting.

The guiding section of continuous casting plants according to the invention is much lighter in weight than comparable guiding sections having longitudinal walking beams. The saving in weight is considerable in plants for casting slabs having a width of or above about 200 cm or more and increases considerably and progressively as the width of the slabs to be cast increases. The drive means or the elements thereof can be arranged laterally of the path for the casting and can be simple in design and reliable in operation; they are disposed outside the regions in which high temperatures prevail and they can all be conveniently supervised. The transverse beams may be relatively narrow and may be sufficiently spaced apart to readily permit an installation of means for an effective cooling of the continuous casting by a sprayed liquid coolant. Because the moving mass is subdivided into a large number of elements of small mass, the cyclic motion can be carried out at a frequency which is much higher than conventional.

The continuous casting is usually at a temperature of at least 1000° C. as it enters the guiding section and at a temperature of about 500° C. as it leaves the guiding section. Each transverse beam engages the continuous casting in a strip-shaped area in which there is only a small temperature gradient of, e.g., 0.3° C./cm, along the casting. For this reason there is no danger of a warping of the transverse beams as a result of temperature differences.

In a highly desirable arrangement, one pair of transverse beams of a plurality of consecutive pairs of such beams in the guiding section and/or the straightening section, as well as the associated props, are mounted in a common beam-mounting frame to form a unit, which is detachably secured to the guiding frame. All of such units which comprise the same number of pairs of transverse beams are preferably identical. The use of such an arrangement will facilitate the installation and removal or replacement of transverse beams and these operations can be carried out from the side of the path for the continuous casting. Whereas each transverse beam may be supported by two or more props, it is preferably supported by a single prop, which desirably extends throughout the length of the beam. Separate drive means are preferably provided at least for that transverse beam which is nearest to the mold, and it may even be desirable to provide separate drive means for each transverse beam. It will depend on the conditions of operation, for instance, on the nature of the metal being cast and on the cross-section of the continuous casting, whether the guiding section can be simplified in that a plurality of consecutive transverse beams are driven by common drive means, for instance in that common drive means are provided for a set of two or three consecutive transverse beams. In such case, one transverse beam of each set is directly driven and is coupled to the other beam or beams of the set to drive the same. It is often useful to adopt a combination, in which separate drive means are provided for the transverse beam which is nearest to the mold, also for each of a plurality of immediately succeeding transverse beams, and common drive means are provided for each set of two or three or more of the remaining transverse beams. Close to the mold, the solidified skin of the continuous casting is still thin and may bulge under the ferrostatic pressure. In this region each area in which the continuous casting is supported should be equal in width to one transverse beam and these areas should be spaced apart by only slightly more than the width of one transverse beam so that the continuous casting can bulge only between relatively closely spaced areas in which it is supported. Because the unsupported areas are short, any such bulges will not be substantial and will grow only slowly. Even such bulges can be avoided if the transverse beams are cyclically moved at a sufficiently high frequency so that the skin of the continuous casting is desirably subjected only to slight flexing.

The forces to be exerted and to be taken up by the transverse beams may be produced and taken up, e.g., by hydraulic actuators, which are reciprocable along the guiding section. It will be more desirable, however, to provide the prop or each of the props which support a transverse beam in the form of a linkage, which is preferably hinged at one end to the transverse beam whereas the other end of the linkage is hinged to the guiding frame or to the beam-mounting frame. Transverse beams connected to such linkages will be more easily movable and can automatically adjust themselves to the shape of the surface of the casting. In a preferred arrangement, the or each linkage associated with at least one transverse beam of each of some pairs of transverse beams and preferably of each of all pairs of transverse beams has a hinge which is carried by a rod, which is biased by a force and can be displaced against said force and may particularly consist of a piston rod of a hydraulic actuator or the like. In that case there will be an upper limit to the compression forces exerted on the continuous casting because the transverse beam can yield. Besides, the rod can be adjustably secured to the guiding frame or the beam-mounting frame so that each beam can be adjusted relative to the other and the arcuate path defined by the guiding section can be conveniently adjusted exactly to a desired configuration. That desired configuration can be changed. Specifically, the arcuate path may be adjusted to the configuration which has proved most desirable for the overall manufacturing process and this can be effected after the operation has started. The selection of the design of the transverse beams is highly independent of the desired configuration of the arcuate path. For instance, transverse beams intended for circular-path guiding sections may readily be incorporated in guiding sections defining a path having a compound curvature, and vice versa. This is not permissible with longitudinal walking beams because they must exactly conform to the curvature of the continuous casting and require a constant curvature in the longitudinal direction of the continuous casting. In a preferred embodiment, the or each prop supporting a transverse beam constitutes a toggle joint, and in at least one of the toggle joints associated with a transverse beam that toggle lever that is hinged to the transverse beam is provided with a cam slot near the transverse beam, the other toggle lever is provided with a cam slot adjacent to the common hinge, and each cam slot receives a crankpin of a driven crank having a fixed axis.

Alternatively, the or each prop supporting a transverse beam may consist of a pivoted arm and said arm or at least one of said arms may be driven to oscillate and for this purpose may be provided, e.g., with a cam slot, which receives a crankpin of a driven crank having a fixed axis. In that case that end of the pivoted arm which is remote from the continuous casting is preferably movable by a fluid-driven actuator toward and away from the continuous casting.

In continuous casting plants according to the invention the continuous casting can be cooled in a simple manner because there will be a strong dissipation of heat through the transverse beams in surface contact with the continuous casting if the transverse beams are adequately cooled. For this purpose the or each linkage supporting a transverse beam may be provided at that end which is near the transverse beam with a preferably hollow cylindrical element or with a bearing trough, and the transverse beam may be provided with a bearing trough or with a preferably hollow cylindrical element, which is in surface contact with the cylindrical element or bearing trough of the linkage. In that case the hollow cylindrical element is adapted to be cooled on its inside surface and may contain, e.g., means for spraying a liquid coolant on the inside surface of the cylindrical element. Such cooling means will adequately cool the transverse beam as well as the linkage and the hinge between the beam and the linkage. In many cases there is no need to spray the continuous casting with cooling water if, e.g., the transverse beam is cooled. In other cases, particularly where the continuous castings are large in cross-section, a spraying of cooling water on the continuous casting is desirable. It has been found that an effective cooling can be effected by transverse beams which include a plurality of cells that are separated by weblike walls and are open on their forward side facing the continuous casting and on their rear side or are covered by an apertured rear wall on their rear side. In such an arrangement, nozzles for spraying liquid onto the surface of the continuous casting through the cells are carried by the beam on its rear side. Because the transverse beam is not moved relative to the continuous casting in contact therewith, there will be no sliding friction by which the solidified skin of the continuous casting could be stressed.

An essential part of any continuous casting plant is a starter. In continuous casting plants defining an arcuate path, that starter consists of a number of articulatedly connected bar elements.

In the known plants, relatively long starters are required, which can be handled only with difficulty. In a continuous casting plant according to the invention the transverse beams provided in the guiding section constitute a large number of consecutive elements which are closely spaced apart and engage the continuous casting in surface contact therewith. If the transverse beams are properly matched with the starter bar elements, entirely satisfactory results can be produced with starter bar means which are relatively short because they consist of a relatively small number of articulated elements so that they are short and light in weight and can easily be handled. The bar elements of such starters consist of crossbars, which have about the same width as the transverse beams and at one end or each end have a longitudinally profiled portion. The guiding section is provided on one or each side with an extension, which cooperates with an end portion of each starter bar element and has a profile that is complementary to the profile of the starter bar element. In guiding sections defining an arcuate path which has a radius of about 10 meters, it will be sufficient to provide such starter in a length of 2 to 3 meters. Such starter can easily be manipulated by means of an overhead crane.

Embodiments of the invention will now be described more fully and by way of example with reference to the accompanying drawings, which are diagrammatic views on different scales.

Figure 1B:
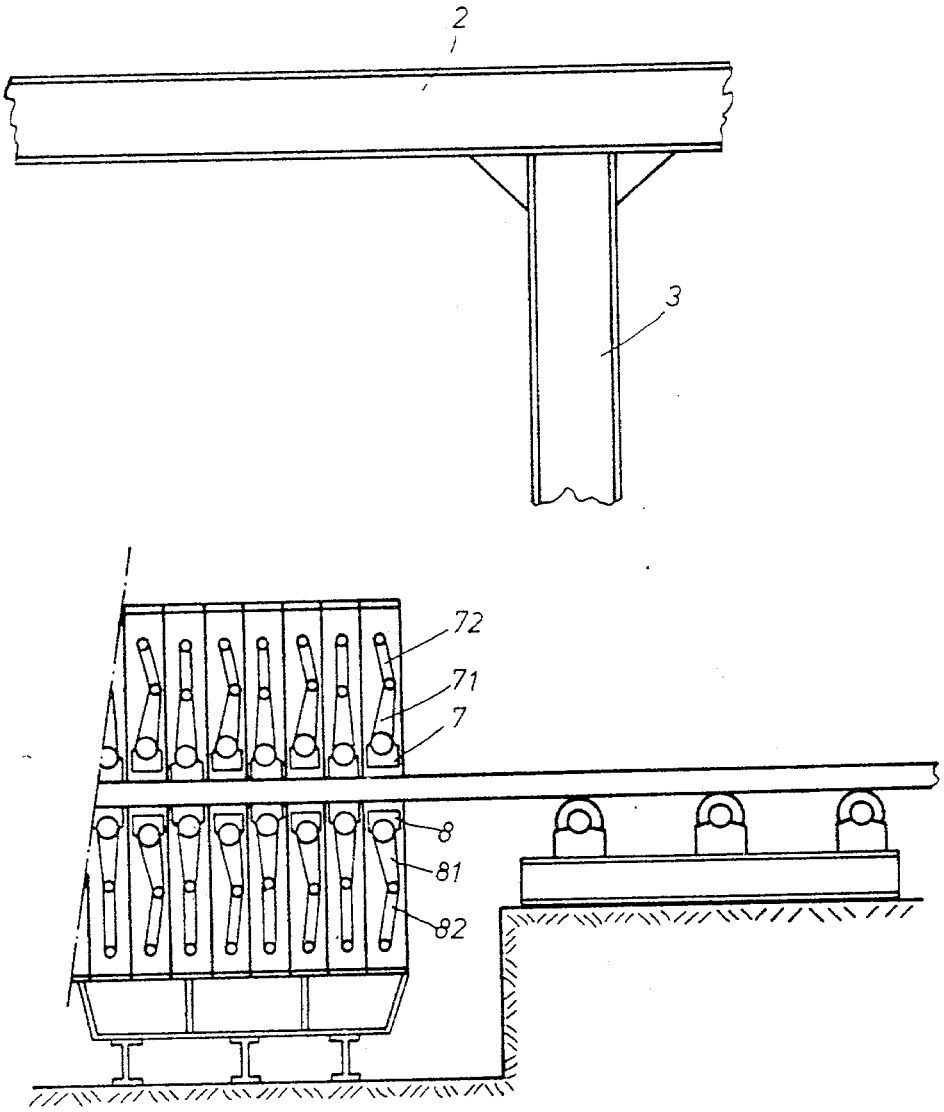
Figure 3:
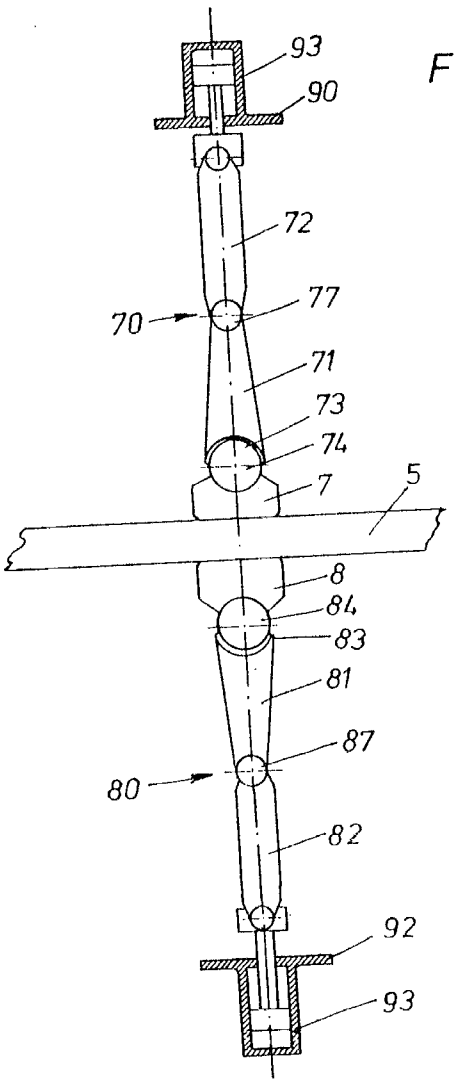
Figure 2:
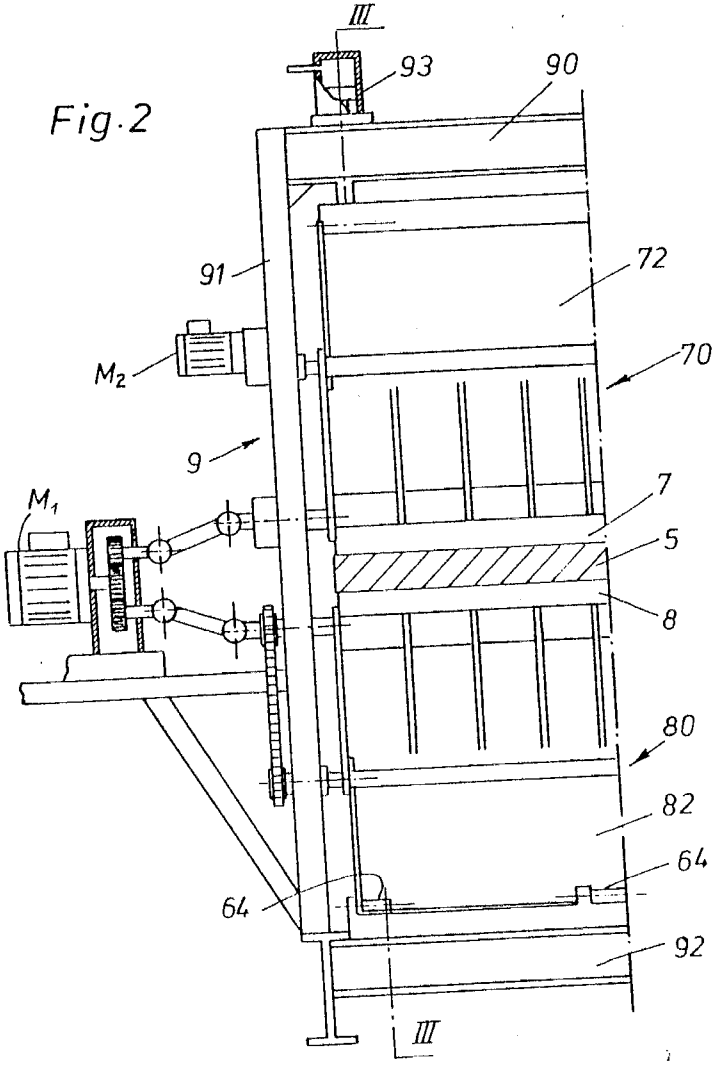
Figure 4:
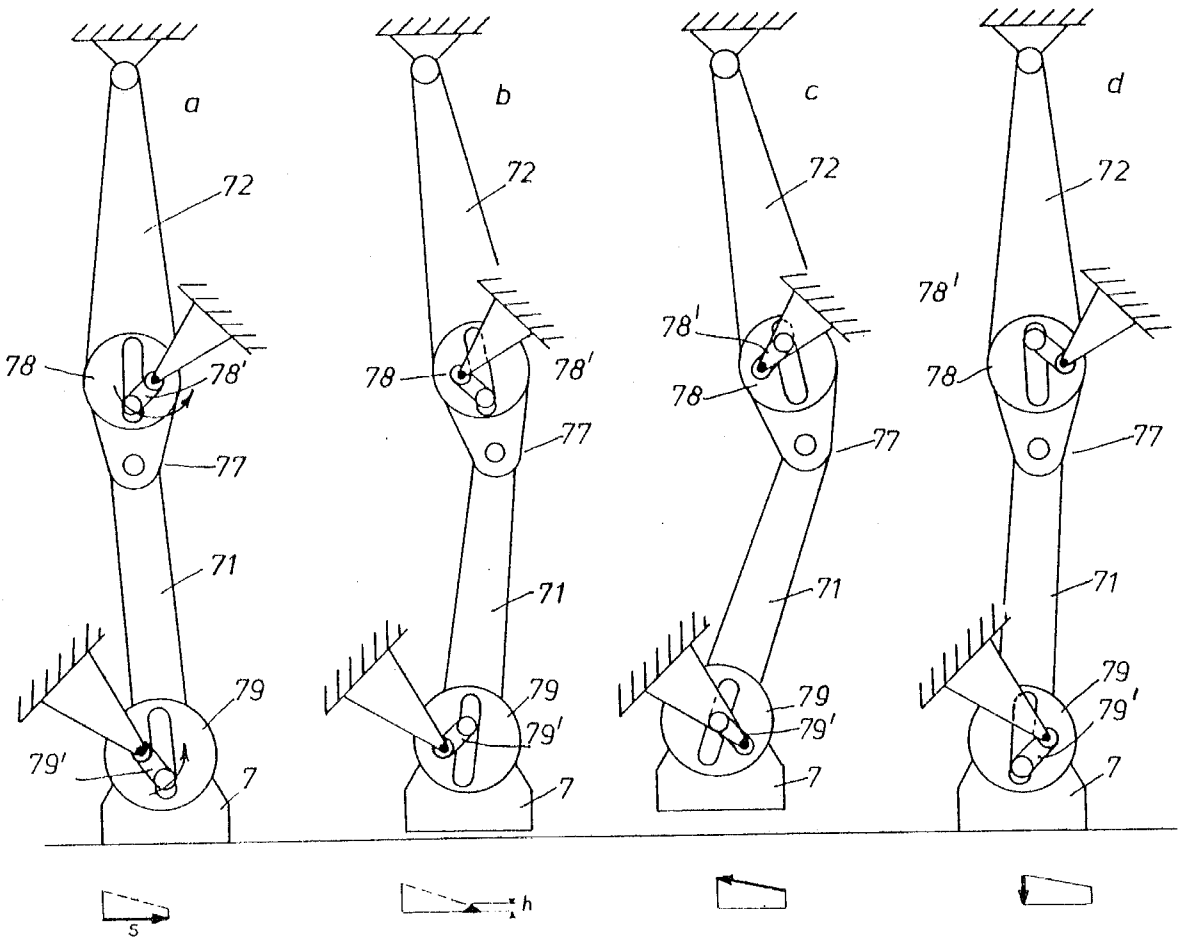
Figure 5:
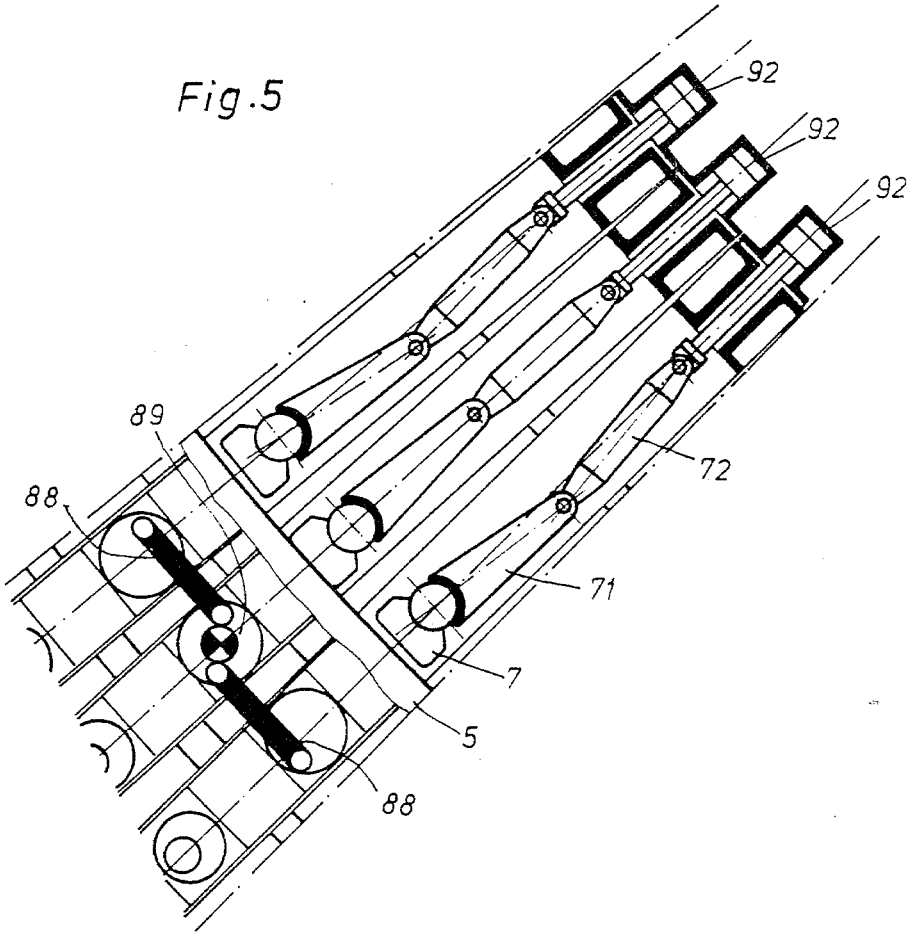
Figure 7:
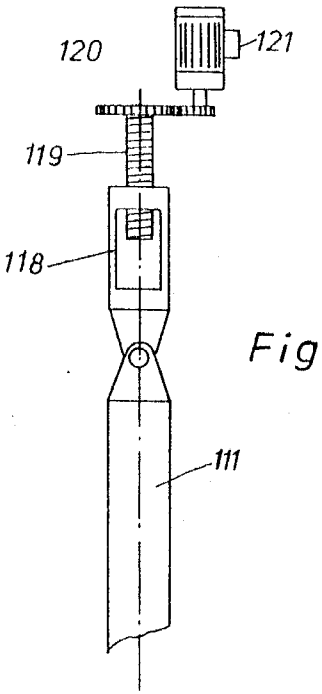
Figure 6:
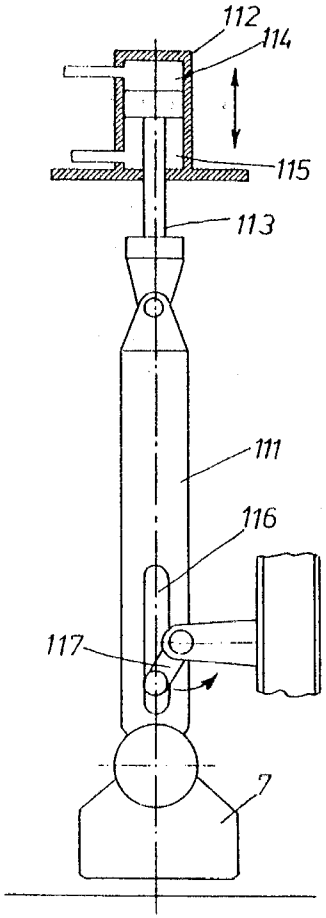
Figure 10:
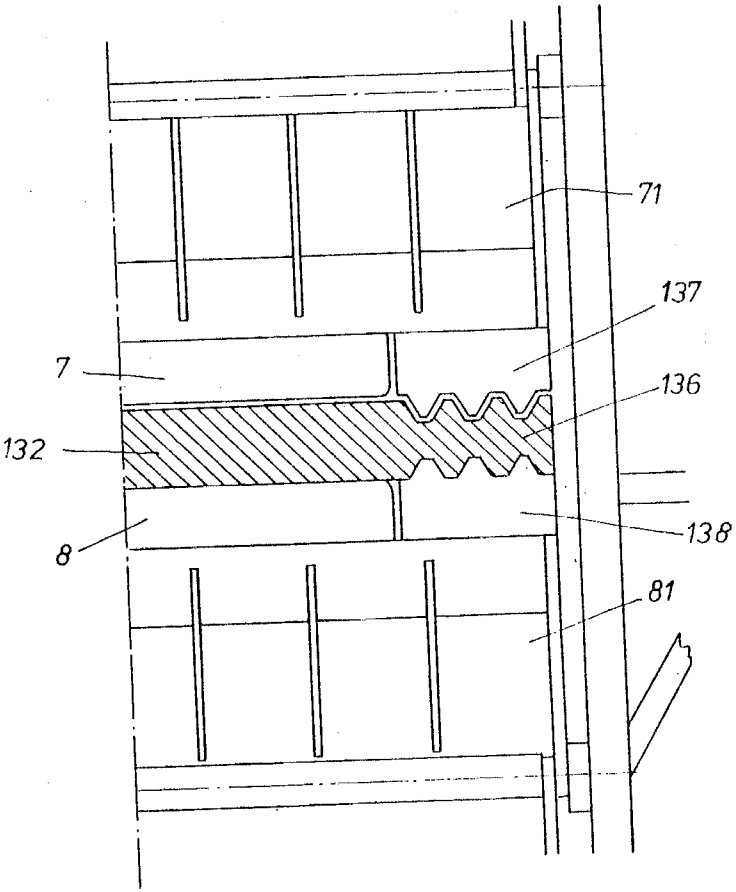
Figure 8:
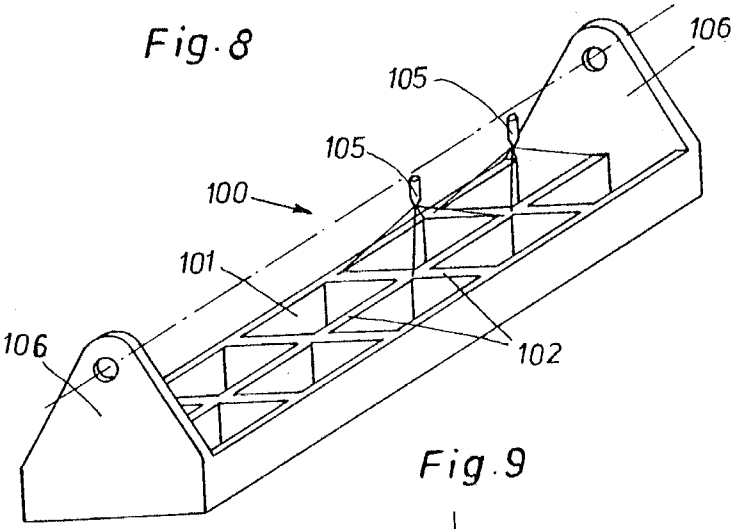
Figure 9:
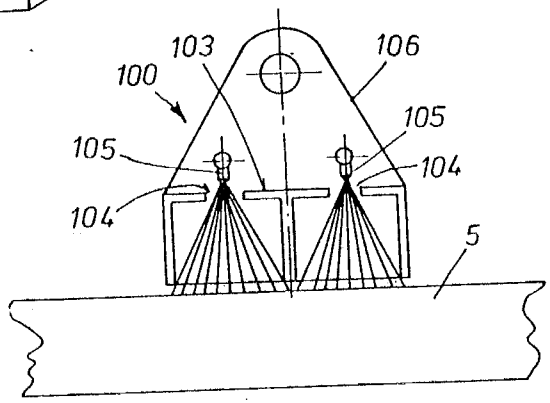

FIGS. 1*a*, and 1*b*, taken together, are a longitudinal sectional view showing an arcuate-path continuous casting plant according to the invention, FIG. 2 shows a machine frame, FIG. 3 is a sectional view taken on line III—III in FIG. 2, FIG. 4 shows a toggle linkage in four phases of motion, FIG. 5 shows a group of three toggle joints driven in unison, FIG. 6 shows a pivoted arm and its drive means, FIG. 7 shows a modified pivoted arm, FIGS. 8 and 9 are, respectively, perspective and sectional views showing a transverse beam, and FIG. 10 shows a guiding section in which a starter has been inserted.

The arcuate-path continuous casting plant shown in FIGS. 1*a* and 1*b* comprises a coolable open-ended mold 1, which is connected to a horizontal beam 2, which is carried by columns 3. A cooling section 4 is provided below the mold. In that cooling section the continuous casting 5 which has emerged from the mold is guided by a grid of crossing bars. The cooling section comprises spraying means (not shown), such as nozzles or nozzle tubes, for spraying a liquid coolant through the grid apertures onto the surface of the continuous casting. The cooling section is succeeded by a guiding section, which comprises a plurality of transverse beams, which are supported by an arcuate guiding frame 6. The continuous casting moves substantially vertically out of the cooling section and is deflected in the guiding section along an arcuate path to a horizontal direction. The transverse beams are arranged in an upper bank and a lower bank. The transverse beams of the upper bank face the concavely curved upper surface of the continuous casting. The transverse beams of the lower bank face the convex lower surface of the continuous casting. Each transverse beam has a major axis extending parallel to one dimension of the beam which is substantially greater than any other dimension of the beam (FIGS. 2 and 3). The transverse beams are arranged in pairs. In each pair, a beam 7 of the upper bank registers with a beam 8 of the lower bank. In the present embodiment, each pair of transverse beams are mounted in a beam-mounting frame 9 (FIGS. 2 and 3), and each mounting beam 7, 8 is connected to a single prop, which extends throughout the length or over a substantial part of the length of the beam-mounting frame. Each prop consists of a toggle joint 70 or 80. Whereas two or more props may be associated with each transverse beam, the use of a single prop for each beam is usually much simpler. The transverse beam 7 or 8 is hinged to the free end of the adjacent toggle lever 71 or 81 of the toggle joint. The free end of the other toggle lever 72 or 82 is hinged to a cross-member 90 or 92 of the beam-mounting frame. The beam-mounting frames are detachably connected to the arcuate guiding frame 6 by bolts or the like so that they can be individually assembled or removed in a simple manner from the side. This operation does not involve a large amount of work and can be accomplished without the use of equipment other than the existing overhead crane for the plant. Another advantage is the simple and weight-saving structure. The guiding frame may consist of simple arcuate beams and is loaded only by the weight of the units consisting of the beam-mounting frames, transverse beams, and drive linkages therefore, and by the weight of the continuous casting. All forces required to control the advance of the continuous casting and the reactions thereto are taken up by the beam-mounting frames 9. These forces and reactions consist essentially of tensile forces to be taken up by the longitudinal members of the beam-mounting frames.

Each beam-mounting frame 9 comprises two longitudinal members 91, which are connected at their upper ends to the cross-member 90 and at their lower ends to the crossmember 92. The latter is provided with footplates, which can be bolted to the guiding frame. Each of the two transverse beams 7 and 8 is connected to the adjacent toggle lever 71 or 81 by a hinge, which comprises a circular cylindrical bearing trough 73 or 83, which is carried by the transverse beam and extends throughout the length thereof, and a hollow cylindrical element 74 or 84, which is in surface contact with the bearing trough and carried by the free end of the toggle lever. The hollow cylindrical element may contain a nozzle tube for spraying a liquid coolant onto that side of the inside surface of the cylindrical element which is opposite to the bearing trough. If the transverse beams are made of a material having a high thermal conductivity, that cooling may be sufficient.

Another embodiment of a transverse beam 100 is apparent from FIGS. 8 and 9. The transverse beam 100 has a number of cells 101 having axes which are normal to the broadside of the continuous casting. The cells are laterally confined and separated by weblike partitions 102. The cells are open at least at their forward side, which faces the continuous casting, and on their rear side are open (FIG. 8) or are partly closed by a rear wall 103, which has an opening 104 adjacent to each cell. The opening at the rear of each cell registers with a nozzle 105 for spraying a liquid coolant through the cell onto the surface of the continuous casting. The nozzles are connected to the transverse beam and are carried, e.g., by supply pipes, which extend between two end walls 106 of the beam. The continuous casting can be satisfactorily supported and effectively cooled by such transverse beams.

The toggle joints 70, 80, specifically their levers 71, 72 and 81, 82, which are connected by a hinge 77 or 87 consisting, e.g., of a pin hinge, may consist of hollow beams, which extend throughout the length of the transverse beams 7 and 8 and are stiffened by transverse walls and are hinged at their outer ends. In the embodiment shown in FIG. 2 the lower toggle lever 82 of the lower toggle joint is hinged on pins 64, which are fixed to the transverse member 92 of the beam-mounting frame. The hinge pins for the toggle lever 72 of the other toggle joint are carried by the transverse member 90 of the beam-mounting frame and adjustable normal to the continuous casting. A hydraulic actuator 93 is mounted on the cross-member near each end thereof. The piston rods of the two actuators are connected to a transverse rod, which is hinged to the free end of the toggle lever 72.

In this arrangement the connection between the toggle lever 72 of the upper toggle joint 70 and the beam-mounting frame is movable normal to the continuous casting against the adjustable force which is exerted by the hydraulic actuator, even when the plant is in operation. It is apparent from FIG. 3 that the toggle lever 82 of the lower toggle joint 80 may also be connected to the beam-mounting frame by hydraulic actuators 93.

It will be understood that a unit need not consist of only one pair of transverse beams with the associated toggle joints or other props but two, three (FIG. 5) or more adjacent pairs of transverse beams together with their toggle joints or other props may be mounted in a common beam-mounting frame to form a unit which can be installed and removed as such.

In the guiding section, the continuous casting should be advanced and deflected and for this purpose should be braked rather than pulled. To that end the transverse beams must perform a controlled movement in engagement with the continuous casting. The continuous casting must always be engaged so that its movement can be controlled by the transverse beams. To that end the pairs of transverse beams are combined in groups and the transverse beams of each group are moved in unison with a phase displacement of approximately half a period from the motion of the beams of another group. As a result, the beams of one group engage the continuous casting and are moved with the advancing casting for a certain distance in engagement with the casting. At the same time, the beams of the other group are disengaged from the casting and returned to their initial position. Separate drive means may be provided for each transverse beam and the transverse beams may be so combined, that each beam, except for the terminal beams of a group, is disposed between two beams of the other group. Alternatively, common drive means may be provided for two, three or more successive beams, which constitute a sub-group and are preferably mounted in a common beam-mounting frame.

Within the invention, these concepts may be combined. Near the mold, the skin of the casting is thin and the distances between the areas in which it is supported must be small. At the delivery end of the guiding section the skin of the continuous casting is already so thick that the skin will resist the ferrostatic pressure even when the skin is exposed over a relatively long distance. For this reason a number of pairs of individually driven transverse beams are preferably provided near the mold and may be succeeded by sub-groups of two or more pairs of transverse beams which are provided with common drive means.

The toggle joints which constitute the props may be light in weight and may consist, e.g., of plates stiffened by longitudinal ribs. There is virtually no risk of a buckling of the relatively short toggle levers stressed in compression so that there is no need for a heavy design. A toggle linkage which may be used for the purpose of the invention is shown in FIG. 4 in four phases a, b, c, d of motion. The toggle lever 72 is provided with a cam slot 78 near the common hinge 77. The other toggle lever 71 is provided with a cam slot 79 near its hinge connection to the transverse beam 7. These cam slots 78 and 79 may be specifically formed in discs secured to the toggle levers and receive crankpins of cranks 78' and 79', respectively, which are rotatable on fixed axes in the same sense with a phase displacement of about 90°. In the four upper diagrams of FIG. 4, the cranks 78', 79' are shown in the position at the beginning of the respective movements a to d. At the beginning of phase a, the transverse beam 7 is in engagement with the continuous casting, which during this phase is advanced by the distance indicated by the arrow s. At the beginning of phase b, the transverse beam begins to disengage from the continuous casting; this movement is continued until the end of this phase and is succeeded by the return movement of the disengaged beam (arrow h) until the end of phase c. The beam is moved into engagement with the continuous casting in phase d. The vector diagrams indicate the distances moved by the beam in each phase and the preceding three phases; these distances are represented by the sides of a quadrangle. In FIG. 4 the cam slots are shown as straight slots although arcuate cam slots may be preferable in practice so that the lifting and advancing movements of the transverse beam can be more accurately merged. Adjacent toggle joints may be connected and driven in unison by cranks 89 and coupling rods 88 provided near those ends of the toggle joints that are close to the transverse beams (FIG. 5). Where adjacent toggle joints are jointly driven, it will be sufficient to drive one of the cranks which are coupled to each other.

A relatively small power will be sufficient to drive the transverse beams of each pair because the toggle joint applies strong forces for engaging the beam with the continuous casting. For this reason it will be recommendable to provide individual drive means for each pair of beams or each set of pairs of coupled beams. The motors, transmissions and all other elements for transmitting power are so light that they can be mounted on the sides of the guiding frame or on the longitudinal members of the beam-mounting frames if suitable supporting brackets are provided whereas other alterations, e.g., of the beam-mounting frames, are not required. Because compressed air and hydraulic liquid are virtually always available, the drive motors may consist of pneumatic or hydraulic drives but may preferably consist of electric motors, which can easily and reliably be synchronized. Those two cranks which are nearer to the continuous casting and associated with two mutually opposite driven beams are preferably driven by a single motor M, via a speed-reducing transmission and two universal-joint shafts extending from said transmission (FIG. 2). The crank of a driving toggle joint which is disposed near the common hinge may be driven either by a separate motor $M_2$ (upper part of FIG. 2) or from the other crank, e.g., via a chain drive (lower part of FIG. 2).

Motion in the longitudinal direction of the casting and transversely thereto can be imparted to the transverse beams in various ways. This can be accomplished in a very simple manner with the aid of the props shown in FIGS. 6 and 7. Each of these props consists of a simple pivoted arm 111, which at one end is connected to the transverse beam 7, e.g., by a hinge. The other end of the pivoted arm 111 is hinged to the piston rod 113 of a double-acting pneumatic or hydraulic actuator 112. The cylinder of the actuator is divided by its piston into two chambers 114, 115. The chamber 114 remote from the pivoted arm 111 always communicates with a source of compressed air, for instance, a container of air under a predetermined pressure. As a result, the piston is constantly biased toward the continuous casting by a force which depends on the piston area and the air pressure and which can be adjusted by a change of that pressure. The other chamber 115 of the cylinder can be selectively connected to or disconnected from a pressure source, which may consist of a container holding a gas or preferably a liquid which is under a higher pressure. When the chamber 115 is relieved from pressure, the force with which the transverse beam engages the continuous casting will correspond to the load applied to the piston by the compressed air in chamber 114. When pressure fluid is admitted to the chamber 115 to provide a higher pressure therein, the force holding the piston in engagement with the casting will be overcome so that the piston will be disengaged from the casting. This engaging and disengaging movement of the piston may be limited by stops. The stroke of the piston may be limited by stops. In this manner, an engaging and disengaging motion is imparted to the transverse beam. Motion in the longitudinal direction of the casting may be imparted to the transverse beam by means of an Ascotch yoke. For this purpose the pivoted arm 11 has a slot 116, which is parallel to the piston rod 113 and receives a pin that protrudes from a crank 117, which rotates on a fixed axis and is preferably disposed near the beam 7. The radius and speed of the crank will then determine the stroke and frequency of the movement in the longitudinal direction of the casting. The times in which the chamber 115 is connected to the associated container must match the rotation of the crank. This need not be explained more in detail. It will be understood that two cylinders may be provided rather than a single cylinder if the pistons of said two cylinders are connected by a common piston rod.

The movement into and out of engagement with the casting need not be imparted to the transverse beams by pneumatic or hydropneumatic drive means but may be imparted by means of a longitudinally slidable nut 118, which is articulatedly connected to the outer end of the prop lever and held against rotation, and a rotatable and axially unmovable screw 119, which is adapted to be driven by a motor 121 by means of a transmission 120.

The difficulties which are involved in the provision of such or similar drive means are much smaller than might be expected in view of the above remarks. For instance, the cylinders of the actuators may be structurally combined and may preferably be adjustably secured to the guiding frame or the beam-mounting frame to extend normal to those surfaces on which the continuous casting is to be supported. Such an arrangement will facilitate the adjustment to continuous castings differing in thickness.

It has already been mentioned that in guiding sections which are designed according to the invention and have no large single masses, the advancing movement of the continuous casting can be divided into numerous small steps, which are performed in rapid succession, for instance, at a frequency of thirty or more steps per minute. In that case, the intervals in which a portion of the solidified skin of the casting is not supported amount only to a few seconds. As the skin of the casting can bulge only slowly, only a very small bulge can be formed by the skin during such a short interval and the flexing of the skin of the casting is reduced to a negligible extent. Such flexing would be adverse to the development of the desired structure in the continuous casting.

The guiding frame 6 may also be simple in structure, particularly when it is designed to carry beam-mounting frames.

It is apparent from FIGS. 1*a* and 1*b* that the guiding frame may comprise a plurality of continuous, substantially arcuate longitudinal beams, which may consist of box sections and have top walls or top surfaces which are curved to conform to the desired configuration of the continuous casting. Each of these longitudinal beams is immovably supported approximately in the middle of its length on a foundation and is movably supported at both ends. Specifically, that end portion of the longitudinal beam which is adjacent to the mold may be vertically movably supported, e.g., on a surface of a column 3, and the other end portion of the longitudinal beam may be horizontally movably supported on the foundation or a supporting block. The upper surfaces of all longitudinal beams lie in a cylindrically curved surface, which has a cross-sectional shape that conforms to the desired arcuate configuration of the continuous casting to be guided, and beam-mounting frames may be mounted on said upper surfaces and may be detachably secured to the longitudinal beams, e.g., by bolts. As has been mentioned before, a strict conforming is not required. The beam-mounting frames or the units in which they are included can be installed from the side and for this reason need not be lifted to a large extend beyond their as-installed elevation. Because the drive means are laterally disposed, such guiding frames 6 and the transverse beams 7, 8 can be inspected also from below. The fixed support or the arcuate beams from below, approximately midway between the means by which the end portions of the beams are movably supported, ensures that the longitudinal beams will not be subjected to buckling loads even during operation as the temperature-dependent length changes become effective in regions which are substantially unsusceptible.

It has already been mentioned that a starter is required in each continuous casting plant. Where the walking beams for supporting the continuous casting and for controlling its advance consist in accordance with the invention of transverse beams spaced apart in the longitudinal direction of the continuous casting, the latter can be supported in a multitude of relatively closely spaced areas because the transverse beams can be relatively narrow and closely spaced apart. For instance, the center planes of adjacent transverse beams may be spaced about 40 cm apart and the adjacent lower edges of adjacent transverse beams may be spaced about 10 cm apart. In such plant the starter may consist of a plurality of elements which are connected by hinges and the spacing of adjacent hinge axes may be equal to the pitch of the transverse beams, i.e., the distance between the center planes of adjacent transverse beams, and in the abovementioned example may also amount to 40 cm. Such starter may be relatively short and flexible and relatively light in weight so that it can easily be handled and may require only a small space (FIG. 1*a*). A starter 131 consisting, e.g., of eleven elements 132 may be carried by a wheeled chassis 133, which is desirably mounted on top of the horizontal beam 2 or between longitudinal beams of the guiding frame and is movable along said guiding frame. The starter lies on an endless chain or the like 134, which is adapted to be driven by the same motor 135 as the chassis or by a separate motor. FIG. 10 is a view that is similar to FIG. 2 and shows two transverse beams 7, 8, which are adapted to be driven by toggle joints. One element 132 of a starter is disposed between the transverse beams 7, 8. The starter elements consists of crossbars, which have an intermediate portion that is as long as each transverse beam 7 or 8 and has virtually the same cross-section as the continuous casting to be formed. The intermediate portion is adjoined at each end by an end portion 136, which has a longitudinal profile consisting, e.g., of one or more longitudinal ribs. That longitudinal profile is complementary to the longitudinal profile of the corresponding one of two extensions 137, 138 provided at opposite ends of each transverse beam 7 or 8, e.g., on sufficiently wide toggle arms 71 and 81. The interengaging profiles of the bar end portions and extensions prevent the starter from slipping laterally out of the space between the two banks of transverse beams.

The arcuate guiding section is succeeded by a straightening section (FIG. 1*b*), which comprises tools consisting of transverse beams, which are also designated 7, 8. These transverse beams are arranged in pairs of registering beams disposed on opposite sides of the continuous casting 5 and are movable into and out of engagement with the casting 5 and reciprocable in the longitudinal direction of the casting 5 and are supported by props against a frame. These props desirably consist of toggle joints 71, 72; 81, 82, and each pair of transverse beams of the straightening section are preferably mounted in a beam-mounting frame. By means of toggle joints for driving the transverse beams in the straightening section, the required straightening forces can be exerted without difficulty. These required straightening forces may be stronger than the forces required to support the curved portion of the continuous casting because the latter has already been substantially solidified before entering the straightening section. For these reasons the transverse beams in the straightening section and the associated drive means may have larger dimensions than the transverse beams and associated drive means in the guiding section. It will often be possible to use identical units in the guiding section and straigthening section; this will obviously be desirable.

The cooling of the continuous casting is difficult and cannot satisfactorily be accomplished in guiding sections provided with rollers. In guiding sections having walking longitudinal beams, the heat is dissipated in relatively large areas so that sharp temperature differences can be avoided, but the cooling cannot be varied in the longitudinal direction of the continuous casting. Different conditions are obtained in guiding sections according to the invention, in which successive transverse beams or groups of transverse beams can be subjected without difficulty to different cooling effects. For this reason, continuous casting processes can also be applied to steel compositions which were previously unsuitable for continuous casting because they are too highly susceptible to an inadequately adapted dissipation of heat. In the process according to the invention, each portion of the continuous casting can be subjected to an uniform, predetermined cooling action. The cooling by means of the transverse beams may be supplemented, particularly in that region of the arcuate portion of the casting which is nearer to the mold, by a cooling effected by a liquid coolant sprayed on the casting.

Even when only one toggle joint or pivoted arm or other prop associated one of two mutually opposite transverse beams is mounted in the guiding section, particularly in a beam-mounting frame, in such a manner that the prop is displaceable against an elastic or constant bias, there will be an upper limit to the supporting forces. If each of the two transverse beams of a pair thereof are mounted to be displaceable against such bias, the arcuate configuration of the continuous casting will not be rigidly fixed but even when the transverse beams are forced against the continuous casting the latter can retain the configuration which it would tend to assume only as a result of its support and the action of gravity, provided that said forces applied by the beams to the casting do not exceed certain limits. As a result, the stresses in the solidified skin of the casting will be decreased, the casting will not be subjected to excessive forces in its longitudinal direction as it is advanced, and it will not be necessary exactly to select a preselected, unvariable arcuate configuration. Where the transverse beams are mounted in beam-mounting frames, a sufficiently close adaptation to a predetermined arcuate configuration can be achieved even though the shape of those curved surfaces of the arcuate longitudinal beams which face the continuous casting does not comply with extremely strict requirements because by means of shims each beam-mounting frame can be reliably held in the desired position reliably and without difficulty.

What is claimed is:

1. In a continuous casting plant comprising a coolable, open-ended mold for delivering a continuous casting and a guiding section for constraining said continuous casting to move away from said mold on a predetermined path and for cooling said casting on said path, said guiding section defining a longitudinal center plane of said path and comprising a guiding frame, two banks of walking beams, each of said banks containing a plurality of walking beams, each of said walking beams having a major axis extending parallel to one dimension of said walking beam which is substantially greater than any other dimension of said walking beam, said two banks of walking beams being mounted in said guiding frame and disposed on opposite sides of said path, and drive means for moving each of said beams in successive cycles including moving said beam from an initial position spaced from said path into engagement with said casting on said path, moving said beam in engagement with said casting along said path away from said mold for a predetermined distance, moving said beam away from said path to disengage said beam from said casting, and moving said beam along said path to said initial position while said beam is disengaged from said casting, each of said banks comprising first and second groups of said beams and said drive means being operable to move the beams of the first groups of both said banks with a phase displacement of about one-half period from the beams of the second groups of said banks, the improvement residing in that each of said walking beams having said major axis extending transversely to said longitudinal center plane, said beams are arranged in pairs of registering beams disposed on opposite sides of said path, a plurality of props are mounted in said guiding frame, each of said beams is connected to at least one of said props at one end of the latter and is supported by said at least one prop in said guiding frame, and said drive means are operatively connected to said beams by said props.

2. The improvement set forth in claim 1 in a continuous casting plant for casting slabs.

3. The improvement set forth in claim 1, in which said path defined by said guiding section is a straight path.

4. The improvement set forth in claim 1, in which the walking beams of one pair thereof and the props associated with said pair are mounted in a common beam-mounting frame to form a unit, which is detachably mounted on said guiding frame.

5. The improvement set forth in claim 1, in which the walking beams of a plurality of successive pairs thereof and the props associated with said plurality of pairs are mounted in a common beam-mounting frame to form a unit, which is detachably mounted on said guiding frame.

6. The improvement set forth in claim 1, in which the walking beams of each of a plurality of sets comprising an equal number of successive pairs of said walking beams and the props associated with the walking beams of said set are mounted in a common beam-mounting frame to form a unit, which is detachably mounted on said guiding frame, and said units are identical.

7. The improvement set forth in claim 1, in which each of said beams is connected to only one of said props.

8. The improvement set forth in claim 7, in which said one prop extends substantially throughout the length of the associated beam.

9. The improvement set forth in claim 1, in which said drive means comprise separate drives for driving each of said beams of the pair thereof which is nearest to said mold.

10. The improvement set forth in claim 1, in which said drive means comprise separate drives for driving each of said beams of a plurality of pairs thereof in a portion of said guiding section which is nearest to the mold.

11. The improvement set forth in claim 1, in which said drive means comprise separate group drives for driving the beams of each of a plurality of groups of successive beams of the same bank thereof.

12. The improvement set forth in claim 11, in which each of said group drives is operatively connected to at least one beam of the associated group only through the intermediary of another beam of the same group.

13. The improvement set forth in claim 1, in which at least one of said props consists of a linkage having a first end connected to the associated beam and a hinged second end connected to said guiding frame.

14. The improvement set forth in claim 13, in which said first end of said linkage is hinged to the associated beam.

15. The improvement set forth in claim 13, in which the second ends of said linkages associated with at least one of said pairs of walking beams are hinged to a common beam-mounting frame, which is detachably mounted on said guiding frame.

16. The improvement set forth in claim 13, in which said second end of at least one of said linkages is hinged to an axially biased rod.

17. The improvement set forth in claim 16, in which said rod consists of a piston rod of a hydraulic actuator.

18. The improvement set forth in claim 13, in which said second end of each of said linkages is hinged to an axially biased rod.

19. The improvement set forth in claim 13, in which each of said linkages consists of a toggle joint having a first toggle lever, which is provided with said first end, and a second toggle lever, which is provided with said second end and connected to said first toggle lever by a common hinge, in at least one of said linkages associated with one of said beams said first toggle lever is provided with a first cam slot near said first end and said second toggle lever is provided with a second cam slot near said common hinge, and said drive means comprise for each of said beams two cranks, which are rotatable on fixed axes and comprise respective crankpins engaging respective ones of said cam slots.

20. The improvement set forth in claim 13, in which each of said linkages consists of a pivoted arm, at least one of said pivoted arms associated with one of said beams is operatively connected to said drive means, and means are provided for moving said second end of said pivoted arm toward and away from said path.

21. The improvement set forth in claim 20, in which said at least one pivoted arm is provided with a cam slot and said drive means comprise for each of said at least one pivoted arm a crank, which is rotatable on a fixed axis and has a crankpin engaging said cam slot.

22. The improvement set forth in claim 13, in which each of said linkages is connected to the associated beam at said first end of said linkage by a hinge comprising a trough bearing and a cylindrical element in surface contact with said trough bearing.

23. The improvment set forth in claim 22, in which said cylindrical element is hollow and cooling means for cooling the inside surface of said cylindrical element are provided.

24. The improvement set forth in claim 1, in which each of said beams has a front side facing said path and a rear side facing away from said path and is formed with a plurality of cells, which are spaced apart along said beam, and with a plurality of webs separating adjacent ones of said cells from each other, each of said cells being open on said front side and at least partly open on said rear side, and each of said beams carries on said rear side nozzle means for discharging a cooling fluid through said cells onto the surface of said casting on said path.

25. The improvement set forth in claim 1, in which said beams have approximately the same width, a starter is provided, which is movable along said path and comprises a plurality of hingedly interconnected crossbars, each of which has approximately the same width as said beams, each of said crossbars has at least at one end a longitudinal profiled end portion, which laterally protrudes beyond said beams when said starter is disposed on said path, and said guiding frame has at least on one side a portion which laterally protrudes beyond said beams and is complementary to and adapted to interengage with said profiled end portions of said crossbars so as to constrain said starter to move along said path.

26. In a continuous casting plant comprising a coolable, open-ended mold for delivering a continuous casting, a guiding section for constraining said continuous casting to move away from said mold on a predetermined arcuate path and for cooling said casting on said path, said guiding section defining a longitudinal center plane of said path and comprising a guiding frame, two banks of walking beams, each of said banks containing a plurality of walking beams, each of said walking beams having a major axis extending parallel to one dimension of said walking beam which is substantially greater than any other dimension of said walking beam, said two banks of walking beams being mounted in said guiding frame and disposed on opposite sides of said path, and drive means for moving each of said beams in successive cycles including moving said beam from an initial position spaced from said path into engagement with said casting on said path, moving said beam in engagement with said casting along said path away from said mold for a predetermined distance, moving said beam away from said path to disengage said beam from said casting, and moving said beam along said path to said initial position while said beam is disengaged from said casting, each of said banks comprising first and second groups of said beams and said drive means being operable to move the beams of the first groups of both said banks with a phase displacement of about one-half period from the beams of the second groups of said banks, and a straightening section for constraining said casting to move along a straightening path, which succeeds said arcuate path, said straightening section defining a longitudinal center plane for said straightening path, two banks of straightening beams disposed on opposite sides of said straightening path, each of said banks of straightening beams containing a plurality of straightening beams, each of said straightening beams having a major axis extending parallel to one dimension of said straightening beam which is substantially greater than any other dimension of said straightening beam, said straightening section comprising additional drive means for moving each of said straightening beams in successive cycles including moving said straightening beam from an initial position spaced from said straightening path into engagement with said casting on said straightening path, moving said straightening beam in engagement with said casting along said straightening path away from said arcuate path for a predetermined distance, moving said straightening beam away from said straightening path to disengage said straightening beam from said casting, and moving said straightening beam along said straightening path to said initial position while said straightening beam is disengaged from said casting, each of said banks of straightening beams comprising first and second groups of said straightening beams, said additional drive means being operable to move the straightening beams of the first groups of both said banks thereof with a phase displacement of about one-half period from the straightening beams of the second groups of said banks thereof, the improvement residing in that each of said walking beams having said major axis extending transversely to said longitudinal center plane of said arcuate path, said walking beams are arranged in pairs of registering beams disposed on opposite sides of said arcuate path, a plurality of props are mounted in said guiding frame, each of said walking beams is connected to at least one of said props at one end of the latter and is supported by said at least one prop in said guiding frame, each of said straightening beams having said major axis extending transversely to said longitudinal center plane of said straightening path, said straightening beams are arranged in pairs of registering beams disposed on opposite sides of said straightening path, each of said straightening beams is connected to at least one additional prop at one end of the latter and is supported by said at least one additional prop, and said additional drive means are operatively connected to said straightening beams by said additional props.

27. The improvement set forth in claim 26, in which said additional props are carried by said guiding frame.

28. The improvement as set forth in claim 26, in which said additional props are mounted in an additional frame.

29. The improvement set forth in claim 26, in which the straightening beams of one pair thereof and the additional props associated with said pair are mounted in a common beam-mounting frame to form a detachably mounted unit.

30. The improvement set forth in claim 26, in which the straightening beams of a plurality of successive pairs thereof and the additional props associated with said plurality of pairs are mounted in a common beam-mounting frame to form a detachably mounted unit.

31. The improvement set forth in claim 26, in which the walking beams of a plurality of successive pairs of said walking beams and the props associated with said plurality of pairs are mounted in a first common beam-mounting frame to form a unit, which is detachably mounted on said guiding frame, the straightening beams of a plurality of successive pairs thereof, which are equal in number to said plurality of successive pairs of said walking beams, and the additional props associated with the straightening beams of said plurality of pairs thereof, are mounted in a second common beam-mounting frame, which is detachably mounted and identical to said first beam-mounting frame.

32. The improvement set forth in claim 26, in which each of said beams is connected to only one of said props.

33. The improvement set forth in claim 32, in which said one prop extends substantially throughout the length of the associated beam.

34. In a guiding section for constraining a continuous casting to move in a continuous casting plant away from a mold on a predetermined path and for cooling said casting on said path, said guiding section defining a longitudinal center plane of said path and comprising a guiding frame, two banks of walking beams, each of said banks containing a plurality of walking beams, each of said walking beams having a major axis extending parallel to one dimension of said walking beam which is substantially greater than any other dimension of said walking beam, said two banks of walking beams being mounted in said guiding frame and disposed on opposite sides of said path, and drive means for moving each of said beams in successive cycles including moving said beam from an initial position spaced from said path into engagement with said casting on said path, moving said beam in engagement with said casting along said path away from said mold for a predetermined distance, moving said beam away from said path to disengage said beam from said casting, and moving said beam along said path to said initial position while said beam is disengaged from said casting, each of said banks comprising first and second groups of said beams and said drive means being operable to move the beams of the first groups of both said banks with a phase displacement of about one-half period from the beams of the second groups of said banks, the improvement residing in that each of said walking beams having said major axis extending transversely to said longitudinal center plane, said beams are arranged in pairs of registering beams disposed on opposite sides of said path, a plurality of props are mounted in said guiding frame, each of said beams is connected to at least one of said props at one end of the latter and is supported by said at least one prop in said guiding frame, and said drive means are operatively connected to said beams by said props.

35. In a straightening section for use in a continuous casting plant comprising a guiding section for constraining a continuous casting to move away from a mold on a predetermined arcuate path and for cooling said casting on said path, which straightening section serves to constrain said casting to move along a straightening path, which succeeds said arcuate path, said straightening section defining a longitudinal center plane for said straightening path and comprising two banks of straightening beams disposed on opposite sides of said straightening path, each of said banks containing a plurality of straightening beams, each of said straightening beams having a major axis extending parallel to one dimension of said straightening beam which is substantially greater than ony other dimension of said straightening beam, said straightening section comprising additional drive means for moving each of said straightening beams in successive cycles including moving said straightening beam from an initial position spaced from said straightening path into engagement with said casting on said straightening path, moving said straightening beam in engagement with said casting along said straightening path away from said arcuate path for a predetermined distance, moving said straightening beam away from said straightening path to disengage said straightening beam from said casting, and moving said straightening beam along said straightening path to said initial position while said straightening beam is disengaged from said casting, each of said banks of straightening beams comprising first and second groups of said straightening beams, said additional drive means being operable to move the straightening beams of the first groups of both said banks thereof with a phase displacement of about one-half period from the straightening beams of the second groups of said banks thereof, the improvement residing in that each of said straightening beams having said major axis extending transversely to said longitudinal center plane of said straightening path, said straightening beams are arranged in pairs of registering beams disposed on opposite sides of said straightening path, each of said straightening beams is connected to at least one additional prop at one end of the latter and is supported by said at least one additional prop, and said additional drive means are operatively connected to said straightening beams by said additional props.

* * * * *